US011877628B2

(12) United States Patent
Takani

(10) Patent No.: US 11,877,628 B2
(45) Date of Patent: Jan. 23, 2024

(54) WATERTIGHT FASTENER AND METHOD FOR MANUFACTURING SAME

(71) Applicant: YKK CORPORATION, Tokyo (JP)

(72) Inventor: Go Takani, Tokyo (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 17/777,280

(22) PCT Filed: Dec. 12, 2019

(86) PCT No.: PCT/JP2019/048618
§ 371 (c)(1),
(2) Date: May 17, 2022

(87) PCT Pub. No.: WO2021/117177
PCT Pub. Date: Jun. 17, 2021

(65) Prior Publication Data

US 2022/0395063 A1 Dec. 15, 2022

(51) Int. Cl.
*A44B 19/32* (2006.01)

(52) U.S. Cl.
CPC ..... *A44B 19/32* (2013.01)

(58) Field of Classification Search
CPC ..... A44B 19/32
See application file for complete search history.

(56) References Cited

U.S. PATENT DOCUMENTS 3,490,109 A * 1/1970 Helmut ..... A44B 19/32 24/389
3,501,816 A * 3/1970 Helmut ..... A44B 19/32 24/389
4,724,586 A * 2/1988 Tsubokawa ..... A44B 19/32 24/384

(Continued)

FOREIGN PATENT DOCUMENTS

CN 2749326 1/2006
CN 2838352 11/2006

(Continued)

OTHER PUBLICATIONS

"Search Report of Europe Counterpart Application", dated Oct. 21, 2022, pp. 1-8.

(Continued)

*Primary Examiner* — Jason W San
(74) *Attorney, Agent, or Firm* — JCIPRNET

(57) ABSTRACT

A watertight fastener includes a pair of fastener tapes; fastener elements provided on a side of one end edge part along a longitudinal direction of the fastener tapes; and a slider engaging and disengaging the fastener elements. On a surface of the fastener tapes opposite to the fastener elements, a waterproof seal layer is provided along the longitudinal direction at a position at which the fastener elements are provided. A width of the waterproof seal layer in a direction orthogonal to the longitudinal direction is narrower than a width of the slider. With the pair of fastener tapes being closed by engagement of the fastener elements, end (Continued)

parts of the waterproof seal layer close to the end edge parts of the fastener tapes come into contact with each other without overlapping in a thickness direction and without a gap to be in close contact in a liquid-tight manner.

4 Claims, 4 Drawing Sheets

(56) References Cited

U.S. PATENT DOCUMENTS

| | | | | |
|---|---|---|---|---|
| 4,888,859 | A * | 12/1989 | Horita | A44B 19/12 24/389 |
| 5,386,616 | A * | 2/1995 | Norvell | A44B 19/32 24/384 |
| 6,343,408 | B1 * | 2/2002 | Neugebauer | A44B 19/32 24/392 |
| 6,427,294 | B1 * | 8/2002 | Shibaike | A44B 19/32 24/381 |
| 8,689,408 | B2 * | 4/2014 | Chou | A44B 19/32 24/389 |
| 8,756,768 | B2 * | 6/2014 | Williams | A44B 19/32 24/389 |
| 10,271,618 | B2 | 4/2019 | La Rocca et al. | |
| 10,800,081 | B2 * | 10/2020 | Chou | A44B 19/32 |
| 11,529,778 | B2 * | 12/2022 | Chou | A44B 19/08 |
| 2002/0017010 | A1 * | 2/2002 | Neugebauer | A44B 19/32 24/391 |
| 2006/0282995 | A1 * | 12/2006 | Liou | A44B 19/32 24/389 |
| 2010/0125982 | A1 * | 5/2010 | Chou | A44B 19/32 24/397 |
| 2016/0255920 | A1 | 9/2016 | La Rocca et al. | |
| 2018/0360172 | A1 * | 12/2018 | Chou | A44B 19/32 |
| 2020/0221831 | A1 * | 7/2020 | Zhang | A44B 19/32 |
| 2021/0107244 | A1 * | 4/2021 | Chou | A44B 19/08 |

FOREIGN PATENT DOCUMENTS

| | | |
|---|---|---|
| CN | 201480203 | 5/2010 |
| CN | 102481038 | 5/2012 |
| CN | 103815624 | 5/2014 |
| CN | 108771308 | 11/2018 |
| CN | 209436409 | 9/2019 |
| JP | S59108502 | 6/1984 |
| JP | S60180516 | 11/1985 |
| JP | S6151119 | 1/1986 |
| JP | H0114168 | 4/1989 |
| JP | 2000312604 | 11/2000 |
| JP | 2008194066 | 8/2008 |
| JP | 2011104371 | 6/2011 |
| TW | I616155 | 3/2018 |
| WO | 2011030442 | 3/2011 |
| WO | 2014010019 | 1/2014 |

OTHER PUBLICATIONS

International Search Report (Form PCT/ISA/210) of PCT/JP2019/048618, dated Mar. 3, 2020, with English translation thereof, pp. 1-5.

Office Action of China Counterpart Application, with English translation thereof, dated Sep. 4, 2023, pp. 1-28.

* cited by examiner

WATERTIGHT FASTENER AND METHOD FOR MANUFACTURING SAME

CROSS-REFERENCE TO RELATED APPLICATION

This application is a 371 application of the International PCT application serial no. PCT/JP2019/048618, filed on Dec. 12, 2019. The entirety of the above-mentioned patent application is hereby incorporated by reference herein and made a part of this specification.

TECHNICAL FIELD

The present invention relates to a watertight fastener having a waterproofing function and a method for manufacturing the same.

RELATED ART

Conventionally, watertight fasteners are provided with a waterproof layer on one surface of a slide fastener to provide a waterproofing function. For example, slide fasteners disclosed in Patent Documents 1 and 2 are provided with a pair of tapes, fastener elements respectively provided along mutually adjacent end edge parts of the pair of tapes, and a slider for engaging and disengaging the pair of fastener elements. The fastener elements in a coil shape are provided on one surface of the pair of tapes, and a waterproof seal material layer is adhered to the entirety of another surface.

A slide fastener disclosed in Patent Document 3 is also provided with fastener elements in a coil shape on one surface of a pair of tapes. A waterproof sealant is coated on this surface where the fastener elements are provided, and the waterproof sealant flows into a gap of the fastener elements and is filled and cured at mutually adjacent end edge parts of the pair of tapes to be in close contact without a gap in a closed state of the pair of tapes.

CITATION LIST

Patent Literature

[Patent Document 1] Japanese Patent Application Laid-Open No. 2011-104371
[Patent Document 2] Japanese Utility Model No. 1-14168
[Patent Document 3] U.S. Pat. No. 8,689,408

SUMMARY OF INVENTION

Problem to be Solved by Invention

The watertight fasteners of the related art above have a complicated manufacturing process, and it has not been considered to provide a waterproofing function in a simple manner. Since the slide fastener disclosed in Patent Document 3 has a waterproof sealant infiltrated into the gap between the fastener elements, the waterproof sealant resists the movement of the slider, the operability at the time of engagement or disengagement is not good, and the fastener tape is not flexible. Further, there is a problem that it is difficult to evenly flow the waterproof sealant between the fastener elements.

The present invention has been made in view of the problems of the related art above, and it is an objective of the present invention to provide a watertight fastener and a method for manufacturing the same which have a simple configuration and can easily obtain waterproofing properties according to a simple manufacturing method.

Means for Solving Problem

The present invention provides a watertight fastener including: a pair of fastener tapes; fastener elements provided on a side of one end edge part along a longitudinal direction of one surface of the fastener tapes; and a slider for engaging and disengaging the fastener elements. On a surface of the fastener tapes on a side opposite to a side on which the fastener elements are provided, a waterproof seal layer with a predetermined width is provided along the longitudinal direction at a position at which the fastener elements are provided. A width of the waterproof seal layer in a direction orthogonal to the longitudinal direction is narrower than a width of the slider. The waterproof seal layer does not come into contact with the fastener elements, and with the pair of fastener tapes being closed by engagement of the fastener elements, end parts of the waterproof seal layer close to the end edge parts of the fastener tapes are shaped to come into contact with each other without overlapping each other in a thickness direction and without a gap to be in close contact in a liquid-tight manner.

The width of the waterproof seal layer in the direction orthogonal to the longitudinal direction may be substantially equal to or narrower than a distance between two ends of the pair of fastener elements in an engaged state. The waterproof seal layer may be formed of, for example, silicone resin.

Along the end edge part of the fastener tape, the fastener element is provided on another surface of the fastener tape at the end edge part which is folded double at a folding line so that the another surface of the fastener tape is convex, and the slider is engaged with the end edge part.

A waterproof layer is provided on a surface of the fastener tape on a side opposite to the fastener element, the waterproof seal layer is provided on a surface of the waterproof layer, and the waterproof seal layer is narrower than a width of the waterproof layer. The waterproof layer may be formed of, for example, a polyurethane resin.

The present invention provides a method for manufacturing a watertight fastener including the following steps. Fastener elements are attached on a side of one end edge part along a longitudinal direction of one surface of a pair of fastener tapes to form slide fastener chains, and the fastener elements are engaged with each other to close the pair of slide fastener chains. A synthetic resin is coated with a predetermined width along the longitudinal direction, on the side of the end edge part of a surface of the fastener tapes which is on a side opposite to the fastener elements, and a coating width of the synthetic resin is formed to be narrower than a width of a slider. The coated synthetic resin is cured and the synthetic resin is cut along the end edge part to form a pair of left and right waterproof seal layers of the pair of fastener tapes. Afterwards, the slider for performing engagement and disengagement is attached to the pair of fastener tapes.

A waterproof layer may be provided on the surface of the fastener tape on a side opposite to the fastener element, the synthetic resin may be coated on a surface of the waterproof layer, and the synthetic resin may be cut along the end edge part to provide the waterproof seal layer.

Effects of Invention

The watertight fastener and the method for manufacturing the same of the present invention have a simple configuration and can easily obtain waterproofing properties according to a simple manufacturing method. Further, in the present invention, since the slider has a configuration sliding without contacting the waterproof seal layer, the sliding resistance of the slider is small and the operability of the slider is good. The reason lies in that, since the resin forming the waterproof seal layer has a higher frictional resistance with respect to the slider as compared with the fastener tape, in the case of a configuration in which the slider slides on the surface of the waterproof seal layer, a relatively large sliding resistance would act on the slider. Further, since the waterproof seal layer is about the width of the fastener element, and the waterproof seal layer is not coated on the other portion of the fastener tape, the waterproof seal layer does not impair the flexibility of the fastener tape. In addition, since the coated synthetic resin is cut along the longitudinal direction with the pair of fastener tapes being closed to provide a pair of left and right waterproof seal layers, the end parts where the pair of left and right waterproof seal layers close each other can be finished neatly, and the waterproof seal layers can be reliably in close contact without overlapping in the thickness direction and without a gap being opened to exert a watertight function.

DESCRIPTION OF EMBODIMENTS

Figure 1:
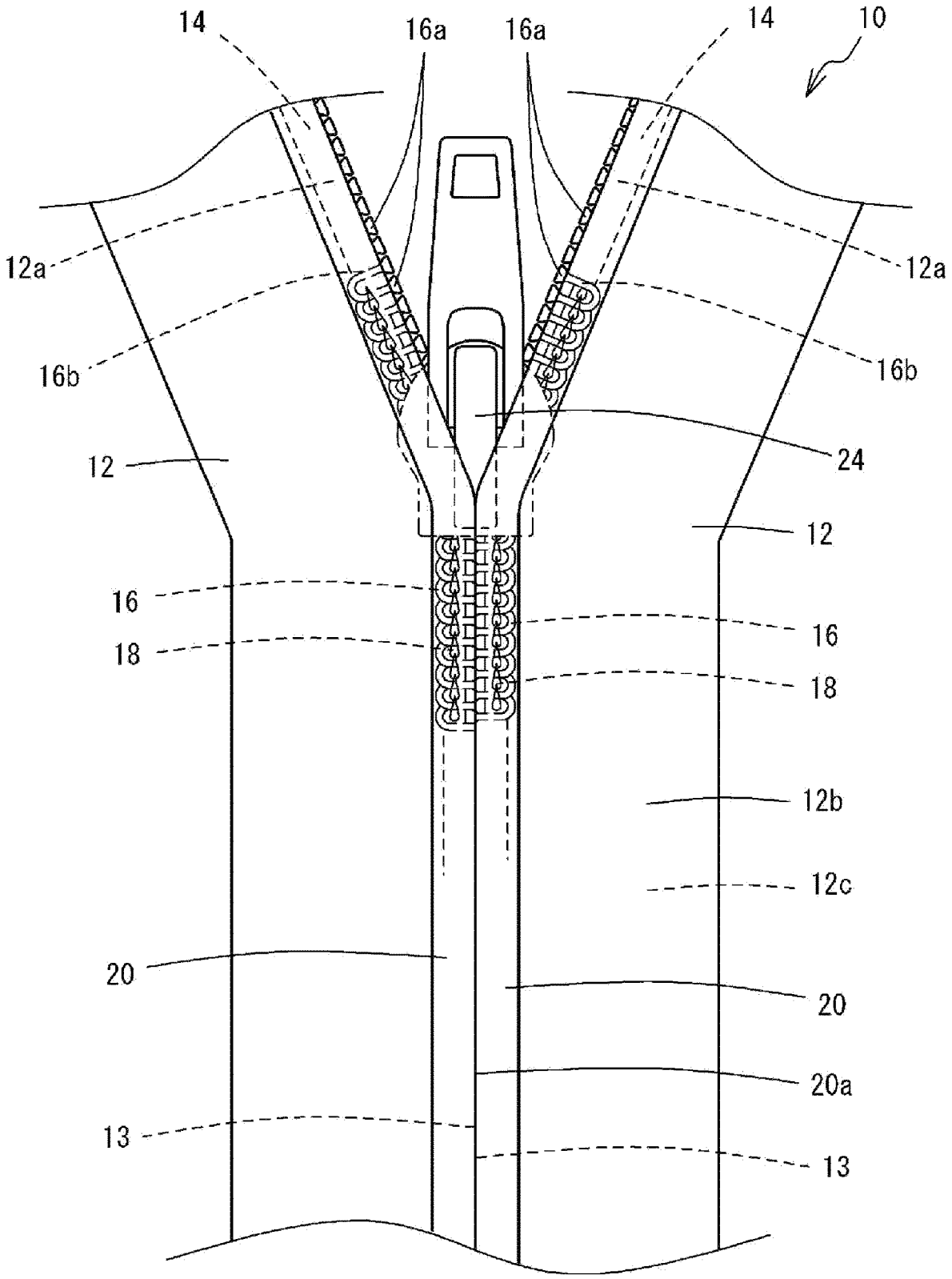
FIG. 1 is a front view of a watertight fastener according to a first embodiment of the present invention.
Figure 2:
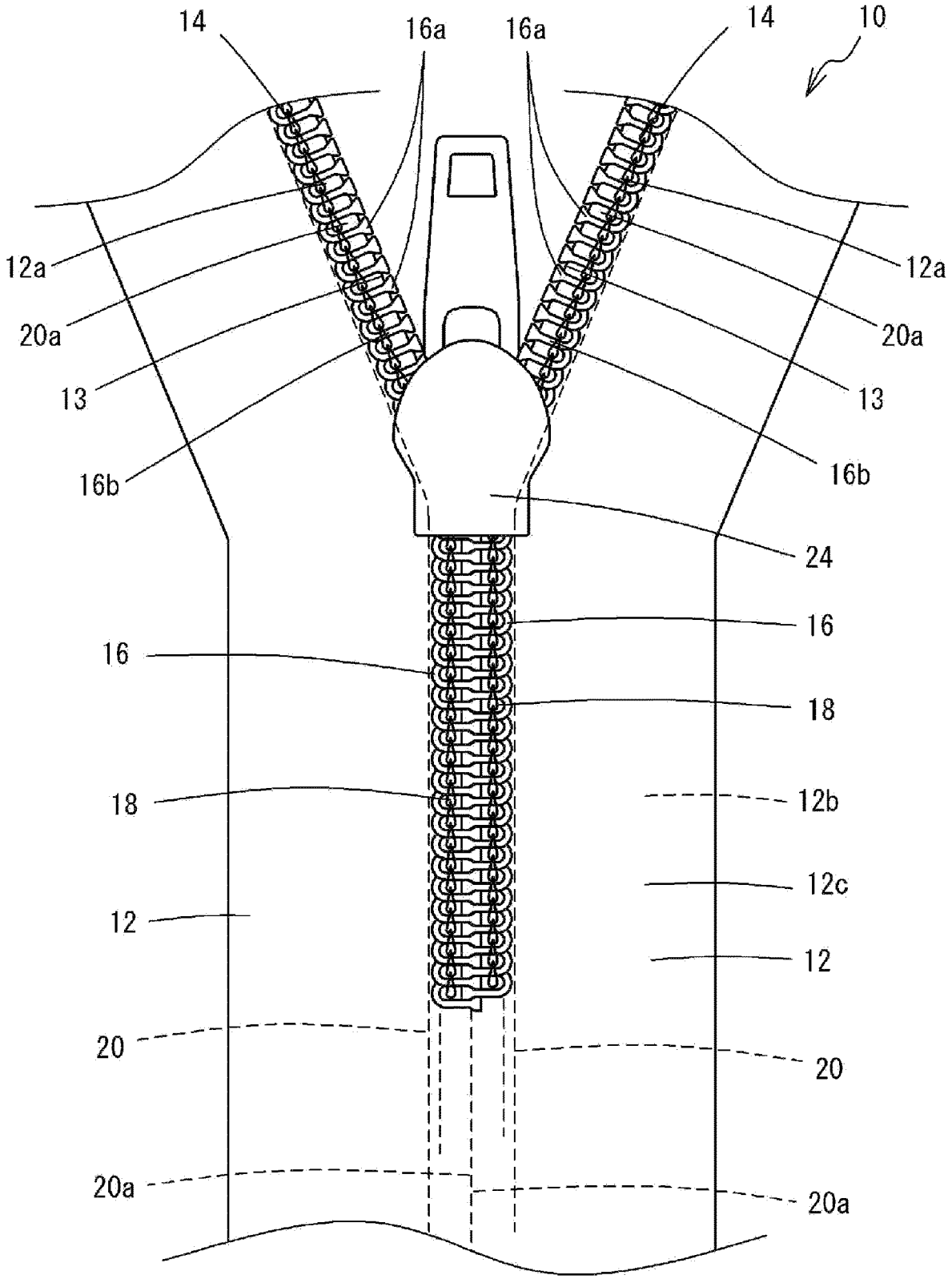
FIG. 2 is a rear view of the watertight fastener according to the first embodiment of the present invention.

Hereinafter, a watertight fastener according to a first embodiment of the present invention and a method for manufacturing the same will be described with reference to the drawings. FIG. 1 to FIG. 4 show the first embodiment of the present invention, and a watertight fastener 10 of this embodiment has a pair of fastener tapes 12, and a fastener element 16 fixed to an end edge part 12*a* of each fastener tape 12 together with a core thread 14. The fastener elements 16 provided at the end edge parts 12*a* of the pair of left and right fastener tapes 12 are each formed by forming one resin monofilament into a coil shape, and are sewn by fixing threads 18 together with the core threads 14.

Figure 3:
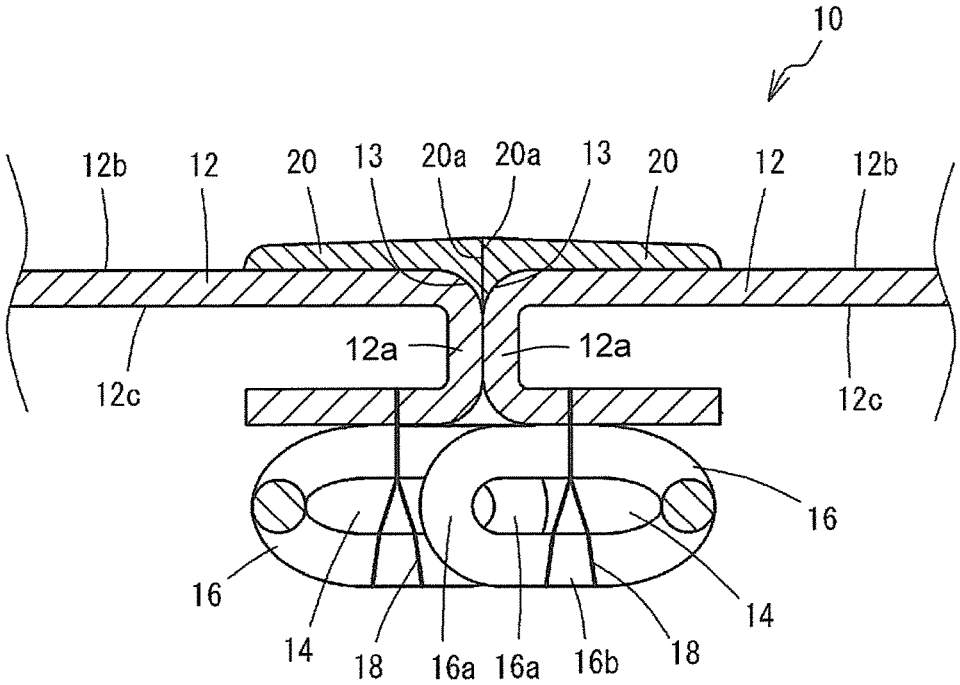
FIG. 3 is an enlarged cross-sectional view of the watertight fastener according to the first embodiment of the present invention.

As shown in FIG. 3, along the end edge parts 12*a* along a longitudinal direction of the fastener tapes 12, a surface 12*b* of the fastener tape 12 is convexly folded double at a folding line 13 to overlap a back surface 12*c*, and the fastener element 16 is fixed to a surface 12*b* side of the overlapped portion. The fastener element 16 is composed of an engagement head part 16*a* having an end part crushed and widened in a radial direction, and a leg part 16*b* extending from the engagement head part 16*a* to a fastener tape 12 side. The fastener elements 16 provided at the mutually opposing end edge parts 12*a* of the pair of fastener tapes 12 are formed as a configuration in which the respective engagement head parts 16*a* are engaged and do not separate from each other in the engaged state. The engagement head part 16*a* protrudes slightly outward beyond the folding line 13.

On the surface 12*b* side of the fastener tape 12, at a position opposed to the fastener element 16 provided on the fastener tape 12 folded double at the folding line 13, a waterproof seal layer 20 is provided substantially centered on the folding line 13, with a predetermined width in a direction orthogonal to the longitudinal direction of the fastener tape 12. The waterproof seal layer 20 is formed of silicone resin, which is a synthetic resin, and is provided on each of the pair of fastener tapes 12, and with the pair of fastener tapes 12 being engaged with the folding lines 13 opposing each other, end parts 20*a*, which are flushly continuous with the folding lines 13, of the pair of waterproof seal layers 20 are in contact with each other in a liquid-tight manner.

Further, the waterproof seal layer 20 is provided only on the surface 12*b* side of the fastener tape 12 and does not come into contact with the fastener element 16. The waterproof seal layer 20 is formed so that the portion at the end part 20*a* corresponding to the folding line 13 is slightly thicker than the other portion. A width of the waterproof seal layer 20 in a direction orthogonal to the longitudinal direction may be formed to be narrower than a width of a slider 24 to be described later. Alternatively, the waterproof seal layer 20 may also have a width substantially equal to or narrower than a distance between two ends of the pair of fastener elements 16 in the engaged state.

Figure 4:
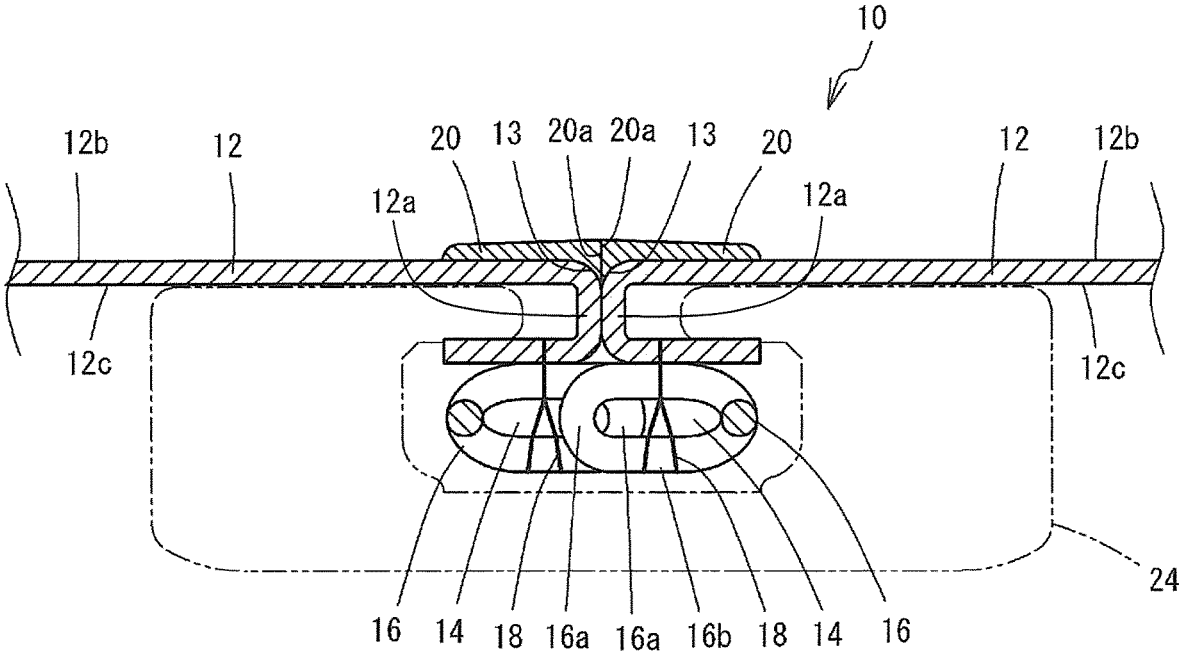
FIG. 4 is an enlarged cross-sectional view of a position where a slider is attached in the watertight fastener according to the first embodiment of the present invention.

In the watertight fastener 10, a slider 24 for engaging and disengaging the fastener elements 16 is mounted on the fastener tapes 12 of a predetermined length to which the fastener elements 16 and the waterproof seal layers 20 have been attached. As shown in FIG. 4, the slider 24 is engaged with the end edge parts 12*a* folded back at the folding lines 13 of the fastener tapes 12, and is located on a back surface 12*c* side of the fastener tape 12.

Next, a method for manufacturing the watertight fastener 10 of this embodiment will be described. First, a fastener element 16 is attached to an end edge part 12*a* of a long fastener tape 12 to form a long slide fastener chain. With the fastener elements 16 of a pair of long slide fastener chains being engaged with each other, silicone resin is coated and cured with a predetermined width along the longitudinal direction of the slide fastener chains at a position where folding lines 13 of the long fastener tapes 12 come into contact with each other. At this time, the silicone resin is coated only on a surface 12*b* side of the fastener tape 12 and does not reach the fastener element 16.

Then, the cured silicone resin is cut along the folding line 13 in a direction substantially at a right angle with respect to the surface 12*b* and is divided into two parts on the left and right. The cut surface becomes a pair of left and right end parts 20*a*, and with the watertight fastener 10 being closed by a slider 24, the end parts 20*a* come into contact with each other without overlapping each other in the thickness direction and without a gap to be in close contact in a liquid-tight manner. When the silicone resin is coated, a center in the width direction is thick due to its viscosity, and the vicinity of the end part 20*a* located at the center in the width direction is formed to be thick.

Afterwards, the long slide fastener chain provided with the waterproof seal layer 20 is cut to a predetermined length, and a slider 24 is attached to form the watertight fastener 10.

Nonetheless, it is also possible that, after cutting the slide fastener chain to a predetermined length, the silicone resin may be coated with a predetermined width, the silicone resin may be cut along the longitudinal direction of the slide fastener chain, and a slider 24 may be attached to form the watertight fastener 10.

According to the watertight fastener 10 of this embodiment and the method for manufacturing the same, with a simple configuration, using a simple manufacturing method, it is possible to easily obtain waterproofing properties at the engagement portion of the fastener elements 16 of the slide fastener. Since the silicone resin forming the waterproof seal layer 20 has a large frictional resistance with respect to the slider 24 as compared with the fastener tape 12, in the case of a configuration in which the slider 24 slides on the surface of the waterproof seal layer 20, a larger sliding resistance would act on the slider 24. However, since the slider 24 of the watertight fastener 10 of this embodiment is configured to slide without contacting the waterproof seal layer 20, the sliding resistance when moving the slider 24 is small, and the operability of the slider 24 is good. Further, since the waterproof seal layer 20 is about the width of the fastener element 16 and the waterproof seal layer 20 is not coated on the other portion of the fastener tape 12, the waterproof seal layer 20 does not impair the flexibility of the fastener tape 12. Further, a thread for attaching to a sewing material to be attached is pierced through the fastener tape 12, and if the waterproof seal layer 20 is at the sewing position, it would be difficult to sew, and the flexibility after sewing would also be deprived. For the above reasons, the waterproof seal layer 20 is preferably about the width of the fastener element 16.

Further, according to the watertight fastener 10 of this embodiment and the method for manufacturing the same, since the silicone resin is coated along the longitudinal direction in a narrow range of a predetermined width including the folding line 13, the work of forming the waterproof seal layer 20 is performed in a short time with high efficiency. By cutting the coated silicone resin in the longitudinal direction, the end parts 20*a* can be finished neatly, and with the pair of fastener tapes 12 being closed, the end parts 20*a*, which are the cut surfaces, are reliably in close contact with each other in a watertight manner without overlapping each other or having a gap. In the waterproof seal layer 20, at the time of coating, the vicinity of the center in the width direction has a high shape due to the viscosity of the silicone resin, and after curing, the vicinity of the cut end parts 20*a* has the greatest thickness and can be in close contact with each other by a wide area. The manufacturing method is simple, can obtain the waterproofing function at low costs, and can be widely used in the sports field, the outdoor field, the casual field, etc.

Figure 5:
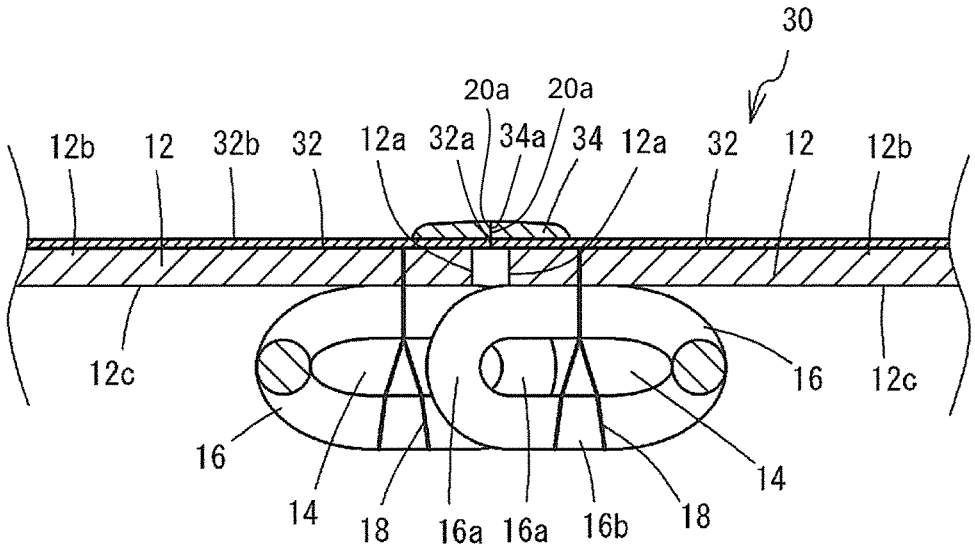
FIG. 5 is an enlarged cross-sectional view of a watertight fastener according to a second embodiment of the present invention.
Figure 6:
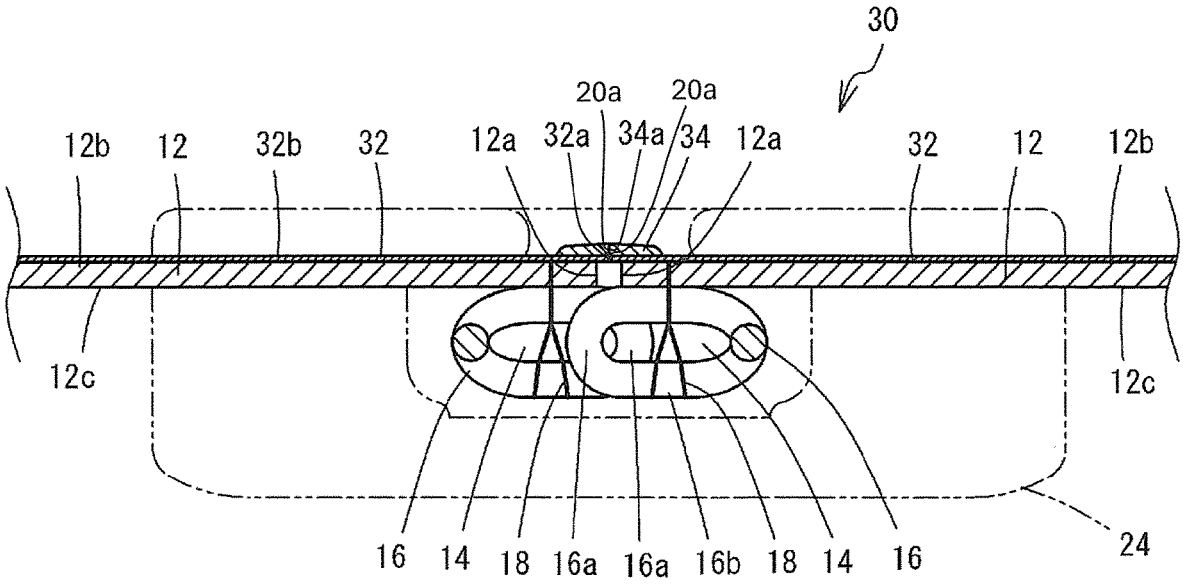
FIG. 6 is an enlarged cross-sectional view of a position where a slider is attached in the watertight fastener according to the second embodiment of the present invention.

Next, a second embodiment of the present invention will be described with reference to FIG. 5 and FIG. 6. Herein, the same members as those in the above embodiment will be labeled with the same reference signs, and descriptions thereof will be omitted. A watertight fastener 30 of this embodiment has a pair of fastener tapes 12, and a fastener element 16 fixed to an end edge part 12*a* of each fastener tape 12 together with a core thread 14. As shown in FIG. 5, the fastener element 16 is attached to a back surface 12*c* along the end edge part 12*a* of the fastener tape 12. An engagement head part 16*a* of the fastener element 16 protrudes slightly outward beyond the end edge part 12*a*.

A surface 12*b* of the fastener tape 12 is covered with a thin waterproof layer 32. The waterproof layer 32 is, for example, a polyurethane film. An end part 32*a* of the waterproof layer 32 on an end edge part 12*a* side of the fastener tape 12 protrudes slightly outward beyond the end edge part 12*a*. Therefore, with the pair of fastener tapes 12 being engaged with each other with the end edge parts 12*a* opposing each other, the end parts 32*a* of the pair of waterproof layers 32 are pressed against and contacted with each other in a liquid-tight manner. The waterproof layer 32 covers a seam of a fixing thread 18 which appears on the surface 12*b* of the fastener tape 12.

On a surface 32*b* of the waterproof layer 32 on a side opposite to the fastener tape 12, a waterproof seal layer 34 is provided along the end part 32*a*, with a predetermined width in a direction orthogonal to the longitudinal direction of the fastener tape 12. The waterproof seal layer 34 is formed by coating silicone resin and is provided on each of the pair of fastener tapes 12, and with the pair of fastener tapes 12 being engaged with each other with the end edge parts 12*a* opposing each other, end parts 34*a*, which are flushly continuous with the end parts 32*a* of the waterproof layer 32, of the pair of waterproof seal layers 34 are pressed against and contacted with each other in a liquid-tight manner. Further, the waterproof seal layer 34 is provided only on the surface 12*b* side of the fastener tape 12 and does not come into contact with the fastener element 16. The waterproof seal layer 34 is formed so that the portion at the end part 34*a* corresponding to the end part 32*a* is slightly thicker than the other portion. A width of the waterproof seal layer 34 in a direction orthogonal to the longitudinal direction may be formed to be narrower than a width of the slider 24, or may be a width substantially equal to or narrower than a distance between two ends of the pair of fastener elements 16 in the engaged state.

Next, a method for manufacturing the watertight fastener 30 of this embodiment will be described. First, a fastener element 16 is attached to a back surface 12*c* of an end edge part 12*a* of a long fastener tape 12 to form a slide fastener chain, and with the fastener elements 16 of a pair of long slide fastener chains being engaged with each other, a waterproof layer 32 is formed on a surface 12*b* of the long fastener tape 12. The waterproof layer 32 may be formed by pasting a polyurethane film or coating a polyurethane resin.

Then, silicone resin is coated and cured with a predetermined width on the surface of the waterproof layer 32 opposed to a position where the fastener elements 16 are engaged. Along a central part where the end edge parts 12*a* of the pair of fastener tapes 12 oppose each other, the cured silicone resin is cut substantially at a right angle with respect to the surface of the cured silicone resin and the waterproof layer 32 to form an end part 34*a* of the waterproof seal layer 34 and an end part 32*a* of the waterproof layer 32 and divide the cured silicone resin into left and right parts. The cut surface becomes a pair of left and right end parts 32*a* and 34*a*, and with the watertight fastener 30 being closed, the end parts 32*a* and 34*a* come into contact with each other without overlapping each other in the thickness direction and without a gap to be in close contact in a liquid-tight manner. Accordingly, the waterproof layer 32 and the waterproof seal layer 34 are provided to overlap each other, and the opposing end parts 32*a* and 34*a* are in close contact with each other in a liquid-tight manner and have a high waterproofing function.

Afterwards, the long slide fastener chain provided with the waterproof layer 32 and the waterproof seal layer 34 is cut, and a slider 24 is attached to form the watertight fastener 30. Nonetheless, it is also possible that, after cutting the slide fastener chain to a predetermined length, the waterproof layer 32 and the waterproof seal layer 34 may be provided, and the slider 24 may be attached to form the watertight fastener 30. When the silicone resin is coated, the thickness of the center in the width direction is thick due to its viscosity, and the end part 34*a* located at the center in the width direction is thick.

In the watertight fastener 30, the slider 24 is mounted on the fastener tapes 12 of a predetermined length to which the fastener element 16, the waterproof layer 32, and the waterproof seal layer 34 are attached. As shown in FIG. 6, the slider 24 is mounted with the fastener tapes 12 interposed therebetween.

According to the watertight fastener 30 of this embodiment, the same effect as the watertight fastener 10 of the above embodiment is obtained. Since the waterproof layer 32 is provided on the surface 12*b* of the fastener tape 12, and the waterproof seal layer 34 is provided on the surface 32*b* of the waterproof layer 32, the waterproofing function at the portion of the fastener tape 12 is high. Since the waterproof layer 32 is provided, the width of the waterproof seal layer 34 can be narrowed. When the waterproof seal layer 34 is coated, the vicinity of the center in the width direction has a high shape due to its viscosity, and the vicinity of the end parts 34*a* has the greatest thickness and can be in close contact with each other by a wide area.

The watertight fastener of the present invention and the method for manufacturing the same are not limited to the above-described embodiments, and the synthetic resin such as silicone resin may be a chemically synthesized material containing synthetic rubber that may be coated and may be closely attached in a watertight state after curing. The configurations of the fastener element and the slider may be freely changed, and the width and the length of the fastener tape may also be freely set according to the use. The materials of the waterproof seal layer and the waterproof layer may be materials other than those described above.

What is claimed is:

1. A watertight fastener comprising:

a pair of fastener tapes (12), each having one surface (12*c*) and another surface (12*b*);

fastener elements (16) provided on a side of one end edge part (12*a*) along a longitudinal direction of the fastener tapes (12), the end edge part (12*a*) being folded double at a folding line (13) to overlap the one surface (12*c*), so that the another surface (12*b*) of the fastener tape (12) is convex and the fastener element (16) being provided on an another surface (12*b*) side of the fastener tape (12); and a slider (24) for engaging and disengaging the fastener elements (16), the slider (24) being engaged with the end edge part (12*a*), wherein on the another surface (12*b*) of the fastener tapes (12) on a side opposite to a side on which the fastener elements (16) are provided, a waterproof seal layer (20) with a predetermined width is provided along the longitudinal direction at a position at which the fastener elements (16) are provided, and a width of the waterproof seal layer (20) in a direction orthogonal to the longitudinal direction is narrower than a width of the slider (24), and the waterproof seal layer (20) does not come into contact with the fastener elements (16), and with the pair of fastener tapes (12) being closed by engagement of the fastener elements (16), end parts (20*a*) of the waterproof seal layer (20) close to the end edge parts (12*a*) of the fastener tapes (12) are flushly continuous with the folding lines (13) and shaped to come into contact with each other without overlapping each other in a thickness direction and without a gap to be in close contact in a liquid-tight manner.

2. The watertight fastener according to claim 1, wherein the width of the waterproof seal layer (20) in the direction orthogonal to the longitudinal direction is substantially equal to or narrower than a distance between two ends of the pair of fastener elements (16) in an engaged state.

3. The watertight fastener according to claim 1, wherein the waterproof seal layer (20) is formed of silicone resin.

4. A method for manufacturing a watertight fastener, comprising:

attaching fastener elements (16) on a side of one end edge part (12*a*) along a longitudinal direction of a pair of fastener tapes (12), each having one surface (12*c*) and another surface (12*b*) to form slide fastener chains, the end edge part (12*a*) being folded double at a folding line (13) to overlap the one surface (12*c*), so that the another surface (12*b*) of the fastener tape (12) is convex and the fastener element (16) being provided on an another surface (12*b*) side of the fastener tape (12), and engaging the fastener elements (16) with each other to close the pair of slide fastener chains;

coating a synthetic resin with a predetermined width along the longitudinal direction, on the side of the end edge part (12*a*) of the another surface (12*b*) of the pair of fastener tapes (12) which is located on a side opposite to the fastener elements (16), wherein a coating width of the synthetic resin is formed to be narrower than a width of a slider (24);

curing the coated synthetic resin and cutting the synthetic resin along the end edge part (12*a*) to form a pair of left and right waterproof seal layers (20) of the pair of fastener tapes (12); and afterwards, attaching the slider (24) for performing engagement and disengagement to the pair of fastener tapes (12), the pair of left and right waterproof seal layers forming one liquid-tight waterproof seal layer (20) when the fastener chains are closed, wherein the waterproof seal layer (20) does not come into contact with the fastener elements (16), and with the pair of fastener tapes (12) being closed by engagement of the fastener elements (16), end parts (20*a*) of the waterproof seal layer (20) close to the end edge parts (12*a*) of the fastener tapes (12) are flushly continuous with the folding lines (13) and shaped to come into contact with each other without overlapping each other in a thickness direction and without a gap to be in close contact in a liquid-tight manner.

* * * * *